US005692315A

United States Patent [19]

Sham

[11] Patent Number: 5,692,315

[45] Date of Patent: Dec. 2, 1997

[54] HAIR STEAMING APPARATUS

[76] Inventor: John C. K. Sham, Rm. 1508, Block C, 19 Broadwood Rd., Hong Kong, Hong Kong

[21] Appl. No.: 552,501

[22] Filed: Nov. 9, 1995

[51] Int. Cl.[6] ..... A45D 00/00

[52] U.S. Cl. ..... 34/99

[58] Field of Search ..... 34/283, 97, 98, 34/99, 100; 132/212, 272; 219/222, 225, 226, 228; 392/380, 382, 383

[56] References Cited

U.S. PATENT DOCUMENTS

| | | | |
|---|---|---|---|
| D. 111,551 | 9/1938 | Schleimer | D28/12 |
| D. 228,697 | 10/1973 | Hill et al. | D28/12 |
| D. 330,270 | 10/1992 | Awan | D28/10 |
| 2,694,206 | 11/1954 | Foster | 4/537 |
| 3,343,530 | 9/1967 | Solos et al. | 601/159 |
| 3,493,722 | 2/1970 | Popeil | 219/222 |
| 3,493,723 | 2/1970 | Popeil | 392/336 |
| 3,495,343 | 2/1970 | Duncanson | 34/72 |
| 3,550,285 | 12/1970 | Omohundro | 34/97 |
| 3,588,444 | 6/1971 | Omohundro | 34/90 |
| 3,646,316 | 2/1972 | Volosin et al. | 219/222 |
| 3,654,428 | 4/1972 | Talge et al. | 219/222 X |
| 3,666,915 | 5/1972 | De Napoli | 219/222 |
| 3,700,853 | 10/1972 | Jensen et al. | 219/222 |
| 3,727,322 | 4/1973 | Walter et al. | 34/99 |
| 3,745,306 | 7/1973 | Naritomi | 392/335 |
| 3,754,116 | 8/1973 | Godel | 219/222 |
| 3,814,111 | 6/1974 | Doyle et al. | 132/272 |
| 3,814,898 | 6/1974 | Levine | 392/404 |
| 3,858,029 | 12/1974 | Walter | 219/222 |
| 3,947,659 | 3/1976 | Ono | 392/404 |
| 4,078,557 | 3/1978 | Spencer | 601/114 |
| 4,112,591 | 9/1978 | Marsh | 34/99 |
| 4,114,022 | 9/1978 | Braulke, III | 392/383 |
| 4,121,353 | 10/1978 | Baumgartner et al. | 34/99 |
| 4,205,692 | 6/1980 | Losenno | 132/212 |
| 4,298,787 | 11/1981 | Barradas | 219/222 |
| 4,314,138 | 2/1982 | Itoh | 392/403 |
| 4,352,248 | 10/1982 | Kobayashi | 34/99 X |
| 4,516,011 | 5/1985 | Jeffress et al. | 219/222 |
| 4,807,604 | 2/1989 | Canela | 601/166 |
| 4,987,618 | 1/1991 | Tolbert | 4/515 |
| 5,010,905 | 4/1991 | Snyder et al. | 132/272 |
| 5,075,908 | 12/1991 | Newman | 4/521 |
| 5,228,213 | 7/1993 | Caruso | 34/60 |
| 5,235,709 | 8/1993 | Terlep | 4/515 |
| 5,286,949 | 2/1994 | Simons | 219/222 |

*Primary Examiner*—John M. Sollecito
*Assistant Examiner*—Steve Gravini
*Attorney, Agent, or Firm*—Salzman & Levy

[57] ABSTRACT

A portable hair steamer suitable for direct application of steam to the hair of the user. The portable hair steamer generally includes a base having a steaming chamber disposed therein and a hood to surround the head of the user. A detachable water tank having a drip or check valve is provided to supply a predetermined rate of water to the steaming chamber. A telescoping neck is provided intermediate the hood and the base and is adjustable for the comfort of the user. The telescoping neck and hood are collapsible against the base to facilitate transportation and storage. An auxiliary steaming chamber may be provided to preheat hair curlers.

14 Claims, 9 Drawing Sheets

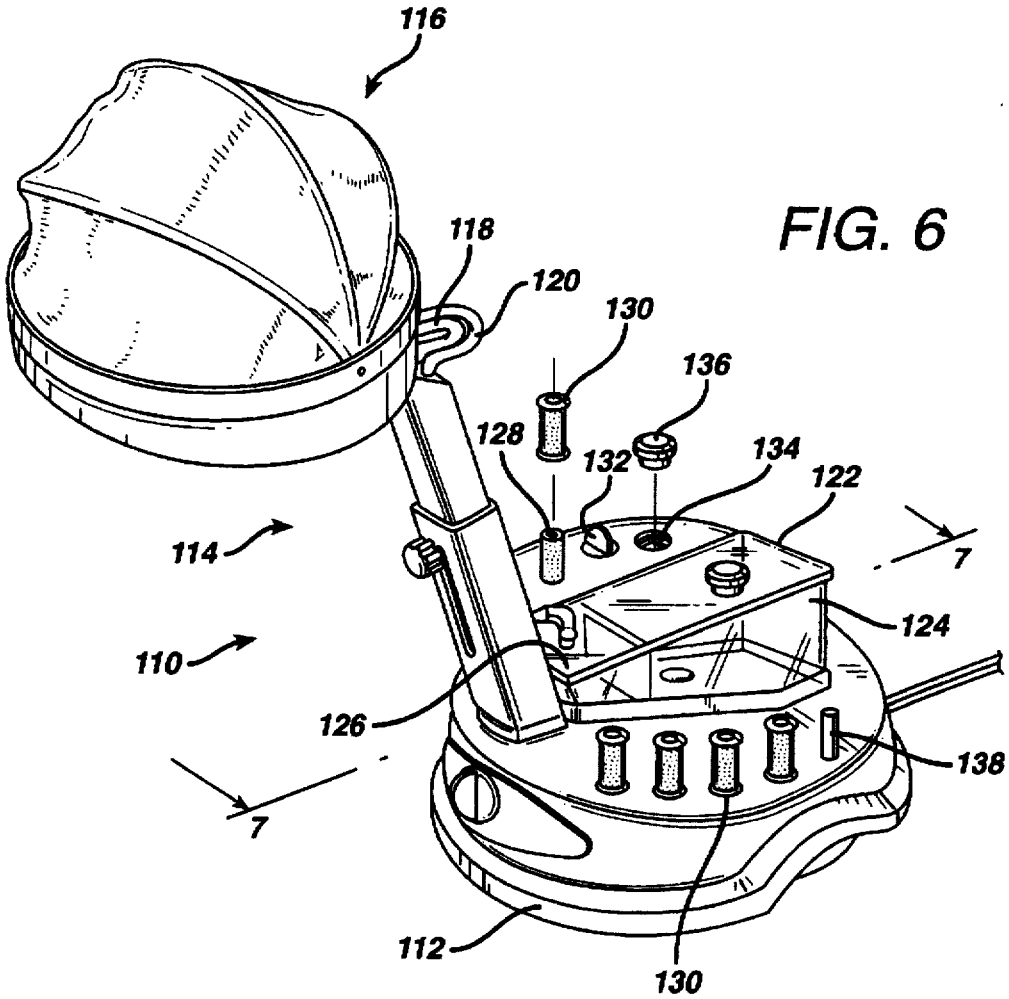
FIG. 6
FIG. 7
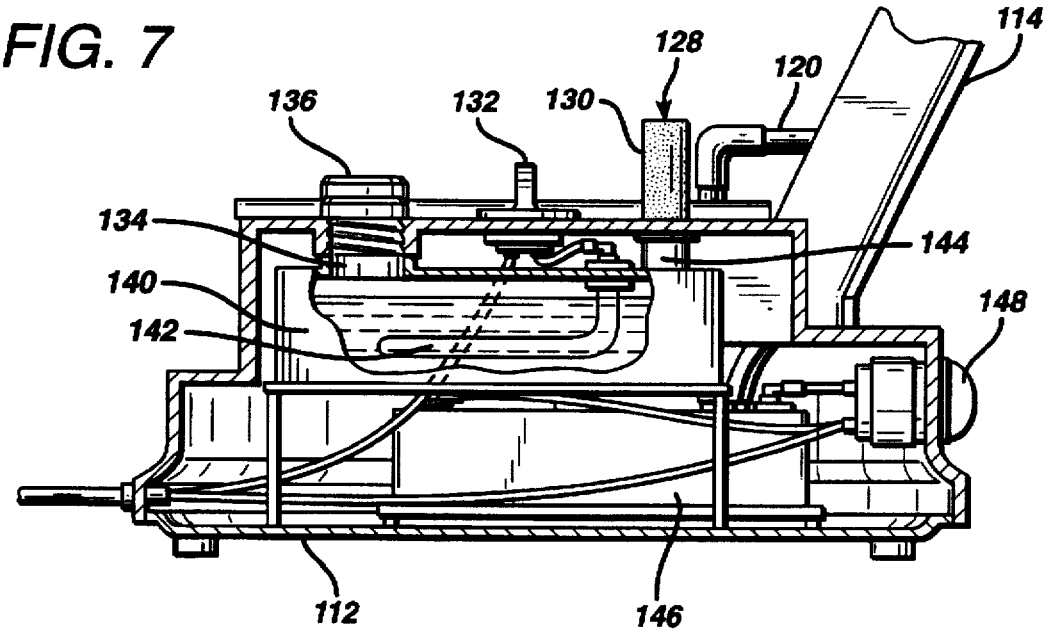

HAIR STEAMING APPARATUS

BACKGROUND OF THE INVENTION

1. Technical Field

The technical field relates generally to devices for the treatment of hair and, more particularly, to a portable hair steamer device.

2. Description of Related Art

During various hair treatment procedures, particularly for women, such as dyeing, shampooing, waving, and curling procedures, hair may lose significant amounts of moisture and thereby become dry and brittle. In some instances, it may be necessary to put moisture back into the hair to compensate for the moisture lost through the hair treatment procedures. Many times this is accomplished through chemical conditioning treatments.

In addition, various devices are known which are designed to apply moisture, in the form of steam, to dried out hair. These devices typically contain a water tank and heating element positioned within the water tank which is used to boil the water at a temperature of approximately 100° C. to thereby generate steam. Steam is allowed to vent out of the water tank or, in some instances, is forced out through the use of fans. The steam removed from the water tank is then directed to the dried out hair in an attempt to reapply moisture.

The known hair steaming devices are typically bulky and difficult to store and transport. Additionally, heating large quantities of water at a time presents various energy and safety concerns. For example, in the event that the device is knocked over, or needs to be drained, scalding of the user may occur. The large quantity of water also requires a correspondingly long boiling period, many times resulting in the device being switched on and left unattended during the heating process.

Thus, there exists a need for a portable hair steamer which is easily collapsible for transportation and storage. Additionally, there is a further need for a hair steamer which heats only a very limited amount of fluid at a time, into the form of steam, to thereby reduce the possibility of scalding the user.

SUMMARY OF THE INVENTION

The disclosed portable hair steamer is designed to create a steady flow of steam utilizing a limited amount of water at a time without having to heat an entire supply of water and is suitable for direct application of steam to the hair of the user. The portable hair steamer generally includes a base having a steaming chamber disposed therein and a hood to surround the head of the user. A steam inlet line is provided and extends between the steaming chamber and an interior of the hood. The steaming chamber includes a heating assembly which preferably comprises two thermostatically controlled heating elements to convert water to steam and a thermal cutoff valve to prevent the heating elements from burning out in the absence of sufficient amounts of water with the chamber. A timer switch on the base controls the length of time the heating elements are on and thus the amount of steam generated.

The hood includes a rigid base forming a ring portion for fitting on a person's head, and a flexible cover which may be partially opened to vent steam or completely collapsed into the rigid base to facilitate storage. The hood further includes a manifold disposed therein, and connected to the steam inlet line, to direct steam within the hood. Additionally, a lip or trough around an inner surface of the rigid base, along with a condensate outlet line, are provided to collect and draw off any condensate which may form within the hood. The condensate is preferably fed back into the steaming chamber for re-steaming, or may be directed to a catch basin.

A detachable water tank having a drip valve, such as a ball check valve, is provided to supply a predetermined rate of fresh supply water to the steaming chamber. The water tank is positionable on the base and positions the drip valve within a water inlet of the steaming chamber. By providing only a predetermined rate of supply water to the steaming chamber the necessity and cost of converting an entire supply of water to steam is avoided. The water is heated to steam virtually instantaneously, thus eliminating the need to boil the entire water supply as in prior art devices.

A telescoping neck is provided intermediate the hood and the base and is pivotally connected thereto. The telescoping neck houses the steam inlet and condensate outlet lines and is adjustable in length for the comfort of the user. Preferably the telescoping neck and hood are collapsible against the base to facilitate transportation and storage.

In an alternate embodiment an auxiliary steaming chamber having separate heating elements and timer switch is provided to preheat hair curlers. The curlers preferably are mounted on hollow posts having outlet ports, and the steam passes through the ports to the curlers. Additionally, a separate tank, formed either within the detachable water tank or standing alone, may be provided to collect the condensate.

BRIEF DESCRIPTION OF THE DRAWINGS

Various embodiments are described herein with reference to the drawings, wherein:

FIG. 6 is a perspective view of an alternate embodiment of a portable hair steamer;

FIG. 7 is a partial side elevational view, partly shown in cross section, taken along the line 7—7 of FIG. 6;

DESCRIPTION OF PREFERRED EMBODIMENTS

Figure 1:
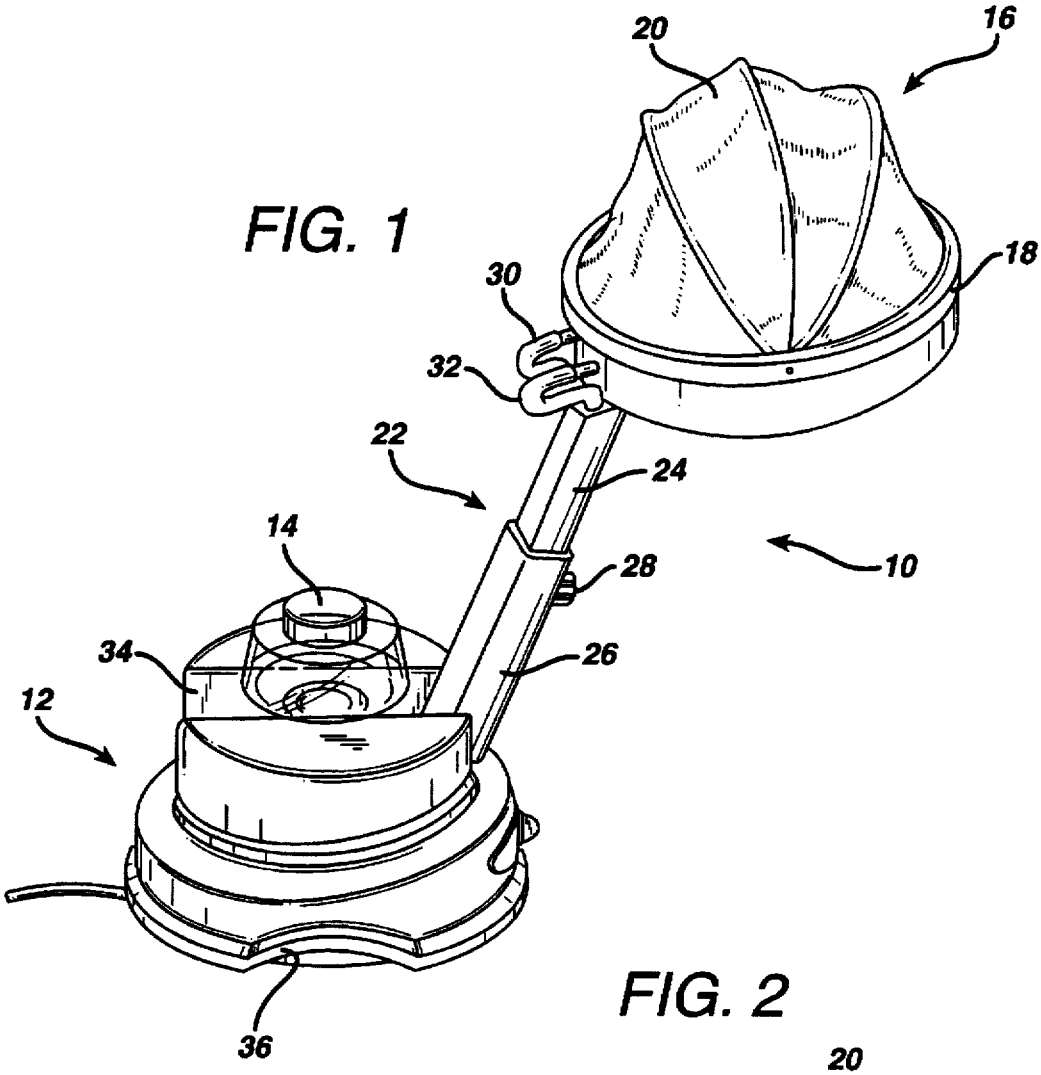
FIG. 1 is a perspective view of one embodiment of the portable hair steamer.

Referring initially to FIG. 1, there is disclosed a portable hair steamer 10 which is collapsible to facilitate transportation from one location to another and for ease of storage. Portable hair steamer 10 is configured to convert a small amount of water at a time into steam relatively instantaneously and transfer the steam to an area around a user's head thereby avoiding the cost and necessity of converting an entire tank of water into steam.

In a preferred embodiment, portable hair steamer 10 generally includes a base 12 having a detachable fresh water tank 14 positioned thereon. A hood 16 is provided to surround the user's head and concentrate the steam against the hair of the user. Preferably hood 16 includes a rigid base 18 having a flexible cover 20 affixed thereon. Hood 16 is connected to base 12 by a telescoping neck 22 which includes an upper neck half 24 and a lower neck half 26. An adjusting knob 28 is provided to adjust the position of upper neck half 24 relative to lower neck half 26 and thus provide an adjustment of the height of hood 16 relative to base 12 and the head of the user. In addition, upper and lower neck halves 24 and 26, respectively, provide means for collapsing neck 22 into portable hair steamer 10.

Portable hair steamer 10 additionally includes a steam inlet line 30 for channeling steam into hood 16 and condensate outlet line 32 for withdrawing condensate formed within hood 16. As noted hereinabove, portable hair steamer 10 is collapsible to facilitate transportation and thus base 12 additionally includes a base recess 34 which is configured to receive neck 22 in a collapsed position. As will be discussed below, recess 34 separates a portion of base 12 into two semicircular volumetric sections which may be utilized as water chambers to eliminate the necessity of detachable tank 14. Additionally, base 12 is provided with scalloped or recessed circumferential areas 36 which result in an ergonomic advantage in transporting the apparatus.

Figure 2:
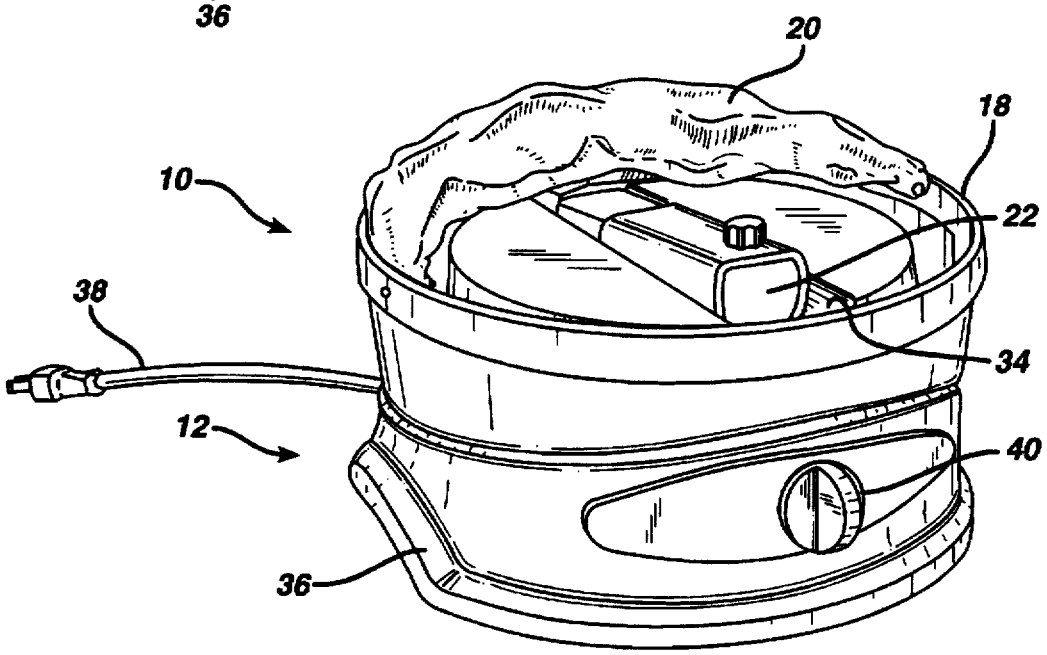
FIG. 2 is a perspective view of the portable hair steamer of FIG. 1 in a collapsed condition.

Referring now to FIG. 2, portable steamer 10 is illustrated in a collapsed condition ready for transportation and storage. As shown, neck 22 is in a collapsed condition and positioned within recess 34 in base 12. Additionally, cover 20 is folded back into a collapsed position within the circumference of rigid base 18. As shown, portable hair steamer 10 additionally includes a power cord 38 and an on/off switch, preferably in the form of a timer-type switch, 40.

Figure 3:
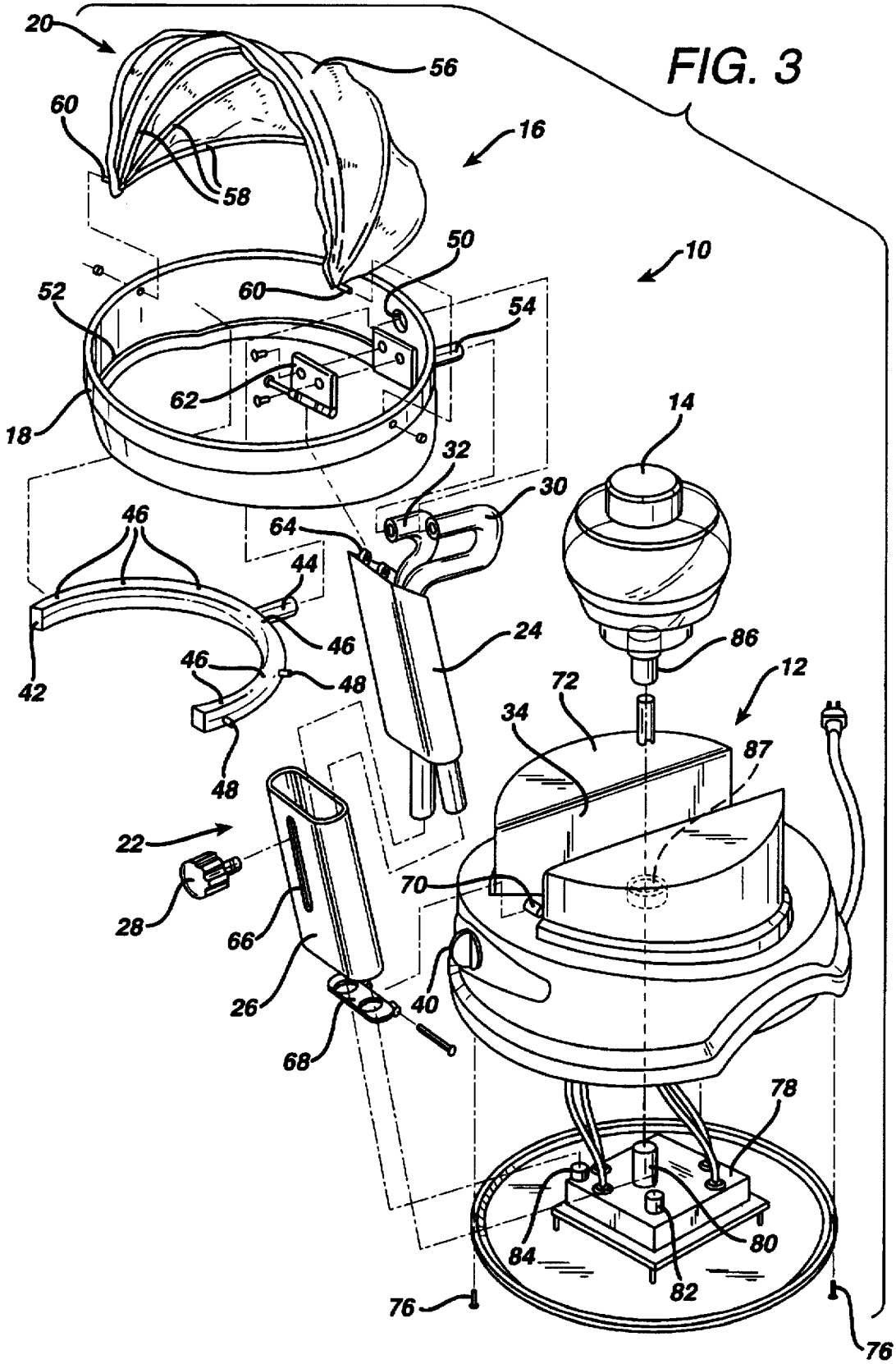
FIG. 3 is a perspective exploded view, with parts separated, of the portable hair steamer of FIG. 1.

Referring now to FIG. 3, and as noted hereinabove, portable hair steamer 10 is particular suited to convert a limited amount of water from detachable fresh water tank 14 into steam, and transporting the steam into an area within hood 16 and about the hair of the user. To accomplish this, hood 16 includes a manifold 42 having a steam inlet 44, which is connectable to steam inlet line 30, and a plurality of steam outlets 46 which are configured to release the steam within an interior of hood 16. Supports 48 are provided on an outer circumferential surface of manifold 42 to support manifold 42 within rigid base 18 of hood 16. When manifold 42 is supported within base portion 18, steam inlet 44 extends through a hole 50 formed in rigid base 18 and is connected to steam inlet line 30. In order to capture any condensate formed against the interior of hood 16 resulting from the steam, there is provided a trough 52 formed on an inner circumference of rigid base 18. Trough 52 is communicable with a condensate outlet 54 which in turn is connected to condensate outlet line 32.

Preferably, flexible cover 20 includes a fabric cover 56 which is supported by a plurality of pivotable ribs 58 configured to support fabric cover 56 in a tent-like fashion. Ribs 58 are pivotally affixed to rigid base 18 by pins 60 or other known fasteners. Thus, by pivoting flexible cover 20 open and closed, by retracting ribs 58 and thus fabric cover 56, small amounts of steam may be vented from hood 16 to cool the user or to lessen the steaming effect if desired. Additionally, cover 20 may be completely collapsed against rigid base 18 to facilitate storage.

To facilitate collapsing portable hair steamer 10 for transportation, a pivot plate 62 is affixed to an inner surface of rigid base 18 and is connectable at a pivot point 64 on upper neck half 24. Thus, hood 16 can be pivoted relative to upper neck half 24. Similarly, lower neck half 26 is provided with a pivot plate 68 which is connectable at a pivot point 70 on base 12, thus allowing neck 22 to pivot relative to base 12. As noted hereinabove, in a collapsed condition, neck 22 is positionable within recess 34 in base 12. To adjust upper neck half 24 relative to lower neck half 26, adjustment knob 28 rides in a slot in lower neck half 26. Thus, by sliding upper neck half 24 relative to lower half 26 and tightening adjusting knob 28, the length of neck 22 may be varied.

Base 12 generally includes an upper base half 72 upon which pivot point 70 is formed and within which recess 34 resides, and a lower base half 74. Preferably, upper base half 72 and lower base half 74 are fixed together with suitable known fasteners, such as, for example, fasteners 76, although other types of assembly arrangements such as, for example, a snap fit or welding configuration may be provided.

In order to convert water received from fresh water tank 14 into steam there is provided a steaming chamber 78 positioned on lower base half 74. Steaming chamber 78 generally includes a fluid inlet port 80 and a steam outlet port 82. Preferably, condensate return line 32 is connected to a condensate inlet port 84 in steaming chamber 78 which helps minimize the amount of water used and also provides a source of preheated water to steaming chamber 78.

As noted hereinabove, portable hair steamer 10 is particularly designed to convert only a limited amount of water into steam at a time to maintain a steady flow of steam, and thus results in a lower power usage than conventional hair steamers. Further, should portable hair steamer 10 be knocked over or drainage desired, only a small amount of fluid is in heated form thus resulting in a very safe apparatus.

Preferably, detachable fresh water tank 14 is provided with a drip or ball check valve 86 which is designed to admit only a limited amount of water, depending on pressure conditions, through fluid inlet port 80 and into steaming chamber 78. Drip valve 86 extends through an aperture 87 formed within upper housing half 72.

Figure 4:
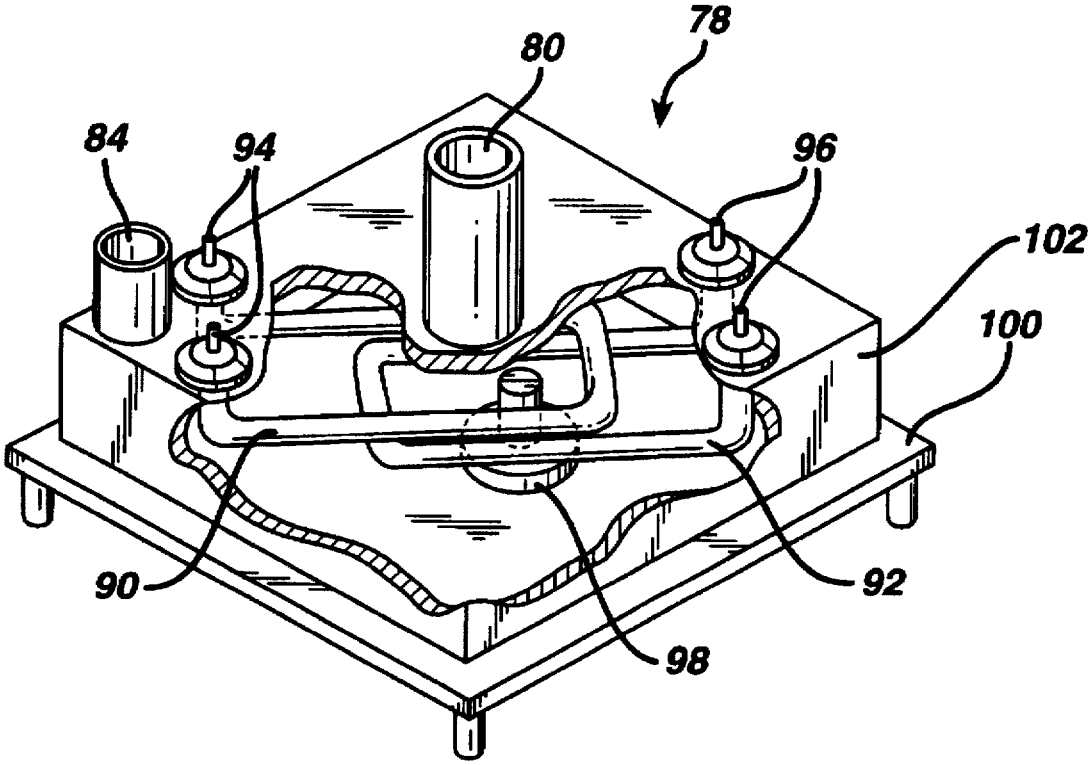
FIG. 4 is a perspective view, partially shown in cross section, of the steaming chamber used within the portable hair steamer of FIG. 1.

Referring for the moment to FIG. 4, steaming chamber 78 may include upper and lower heating elements 90 and 92 respectively. Heating elements 90 and 92 are provided to immediately boil or convert small amounts of water into steam for release within an inner area of hood 16. Upper and lower heating elements 90 and 92 include upper and lower electrical contacts 94 and 96 which are connectable to timer on/off switch 40 and ultimately power cord 38 to provide power to heating elements 90 and 92. Steaming chamber 78 additionally includes a thermostat and/or a thermal cutoff type sensor switch 98 which shuts off power to upper and lower heating elements 90, 92 in the event the fluid level in steaming chamber 78 falls below a predetermined range. Thus, in this manner boil off or boil dry within heating chamber 78 is prevented. Alternately, a float switch may be provided to prevent boil-dry conditions.

Steaming chamber 78 generally includes a base plate 100 and a chamber cover 102 which form an area within which upper and lower heating elements 90 and 92 reside and within which fluid is converted to steam.

The operation of portable hair steamer 10 will now be described. Initially referring to FIG. 2, portable hair steamer 10 is removed from storage and transported to an appropriate location. Portable hair steamer 10 is initially in a collapsed configuration with neck 22 residing within recess 34 and flexible cover 20 folded back within rigid base 18.

Figure 5:
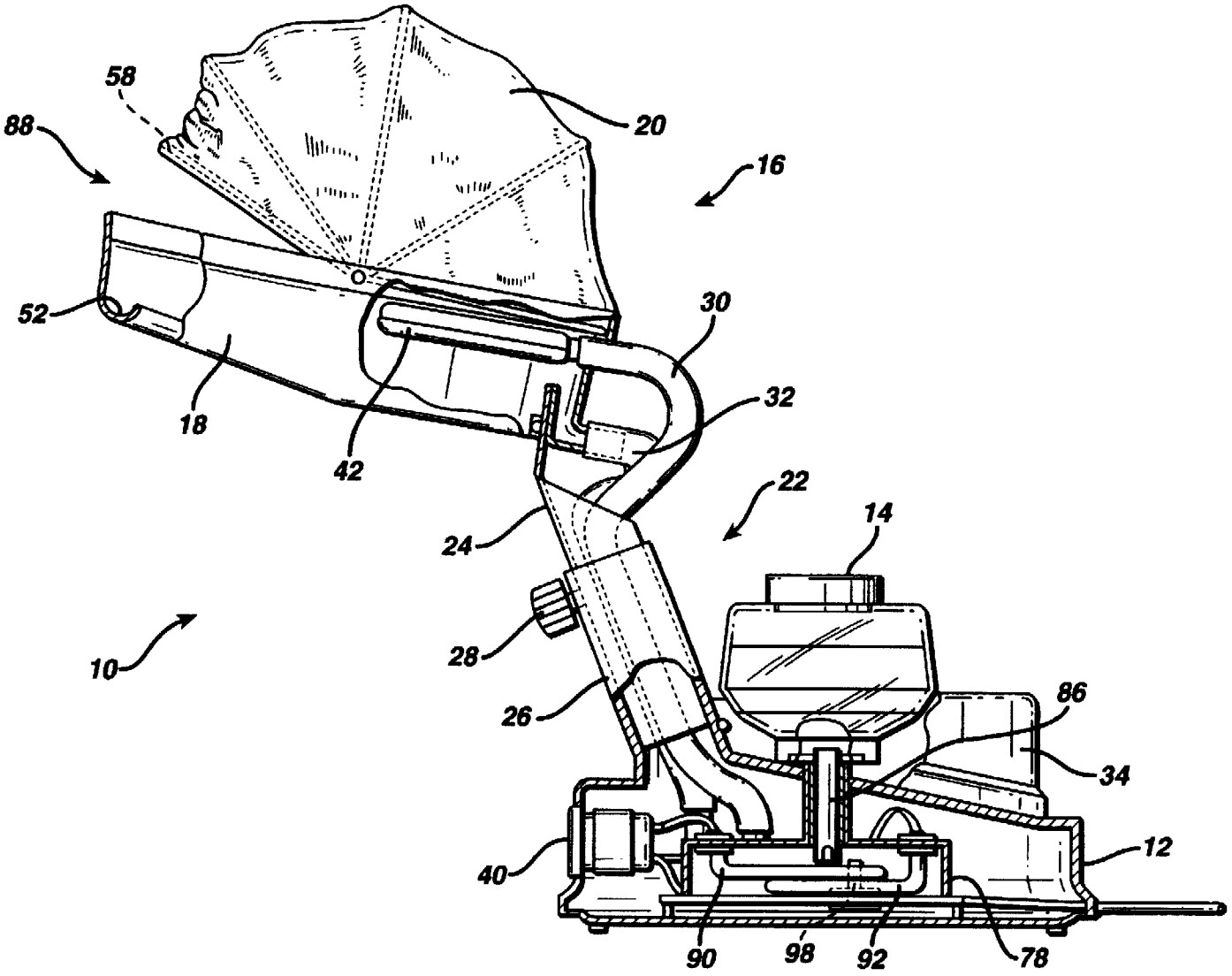
FIG. 5 is a side elevational view, partly shown in cross section, of the portable hair steamer of FIG. 1.

Referring now to FIG. 5, to set up portable hair steamer, neck 22 is pivoted up and out of recess 34 and neck halves 24 and 26 are adjusted to an appropriate height by means of adjusting knob 28. Flexible cover 20 is folded over rigid base 18 by drawing fabric cover 56 and thus pivotable ribs 58 over base 18.

As shown, it may be preferable to pivot ribs 58 less than completely to provide a small steam release gap 88 between an edge of cover 20 and rigid base 18. Detachable water tank 14 is then filled with water and inserted through hole 87 to position drip valve 86 within fluid inlet 80 of steaming chamber 78. Once power cord 38 has been connected to an appropriate power source, hood 16 may be positioned about a user's head and on/off switch timer knob 40 adjusted to provide the desired length of steaming time. Once timer knob 40 has been turned on, thermal cutoff switch 98 monitors the temperature of the healing elements within steaming chamber 78 and allows upper and lower heating elements 90 and 92 to be turned on when sufficient water is present within steaming chamber 78. It will be noted that until thermal cutoff switch 98 senses the appropriate temperature, upper and lower heating elements 90 and 92 remain off. Check valve 86 permits water to enter chamber 78 at a predetermined rate and adds water as the initial quantity is boiled off as steam.

As upper and lower heating elements 90 and 92 boil water within steaming chamber 78 the water is converted to steam and flows out through steam outlet 82 and upwardly through steam inlet line 30 to manifold 42 where steam is released to an interior of hood 16. During the hair steaming operation any steam which condenses within an inner surface of hood 16 is collected within trough 52 and channeled through condensate outlet 54 to condensate line 32. Preferably condensate outlet line 32 channels the condensate fluid back into steaming chamber 78 by means of condensate inlet 84. Alternatively, condensate outlet line 32 may be connected directly to fresh water tank 14 or directed off into another suitable container, particularly if oils or conditioners are also being applied.

As noted hereinabove, drip valve 86 on detachable fresh water tank 14 provides a steady supply of water to steaming chamber 78 without having to boil the entire contents of water tank 14. In the event the supply of fluid to steaming chamber 78 is too slow, or the fluid level in chamber 78 falls below a predetermined level, thermal cutoff switch 98 turns off upper and lower heating elements 90 and 92, thereby preventing a boil dry condition wherein upper and lower heating elements 90 and 92 are turned on and insufficient amounts of fluid are present in heating chamber 78.

Once the appropriate time has been achieved by timer knob 40, or in the event the user desires to terminate the hair steaming session earlier, upper and lower heating elements 90 and 92 are turned off and fluid is no longer converted to steam. Detachable water tank 14 may then be removed and emptied of its contents. Only a minimal amount of water will remain within steaming chamber 78 and thus only a limited amount of hot water is present. Only a little fluid need be drained from portable hair steamer 10 prior to re-collapsing hair steamer 10 for transportation and storage.

Referring now to FIG. 6 there is disclosed an alternate embodiment of a portable hair steaming apparatus. Portable hair steamer 110 is similar to portable hair steamer 10 described hereinabove and generally includes a base 112, a telescoping neck 114 and a steaming hood 116. There are also provided a steam inlet line 118 and a condensate outlet line 120 for admitting steam into, and withdrawing condensate out of, hood 116, respectively. Portable hair steamer 110 further includes a fluid tank 122 which may be detachable and which is provided to supply fresh water to portable hair steamer 110 through a fresh water section 124 formed within fluid tank 122. Fluid tank 122 additionally includes a separate condensate collecting section 126 for collecting condensate formed with hood 116.

Portable hair steamer 110 additionally includes an auxiliary steaming mechanism for preheating hair curlers. Preferably a steaming post such as for example, steaming post 128, is formed on base 112. Alternately, a plurality of posts 128 may be provided to steam a number of curlers 130 simultaneously. Hair curlers 130 are positionable about steaming post 128 and can be preheated thereon. An auxiliary timer 132 may be provided to control the duration of preheating of curlers 130. An auxiliary fluid tank inlet 134 is provided in base 112 and includes a pressure inlet cap 136. A plurality of storage posts, such as storage post 138 may be provided on base 112 to hold additional curlers 130.

Referring now to FIG. 7, auxiliary steaming chamber 140 is formed within base portion 112 and generally includes a heating element 142. Steam outlet 144 formed in auxiliary steaming chamber 140 directs steam to steaming post 128. Portable hair steamer 110 also includes a main steaming chamber 146 and a main timer 148 similar to steaming chamber 78 and timer 40 described with respect to portable hair steamer 10 hereinabove. Alternately, steaming post 128 may be connected to main steaming chamber 146 and auxiliary steaming chamber 140 may be eliminated.

In using the hair curler preheating portion of portable hair steamer 110, a hair curler 130 is initially positioned on steaming post 128 and steaming chamber 140 is filled to the desired level with fluid through fluid inlet 134. Timer 132 is then set to an appropriate duration for steaming hair curler 130. Once hair curler 130 has been preheated it may be removed and additional hair curlers 130 placed upon steaming post 128 to preheat them.

Figure 8:
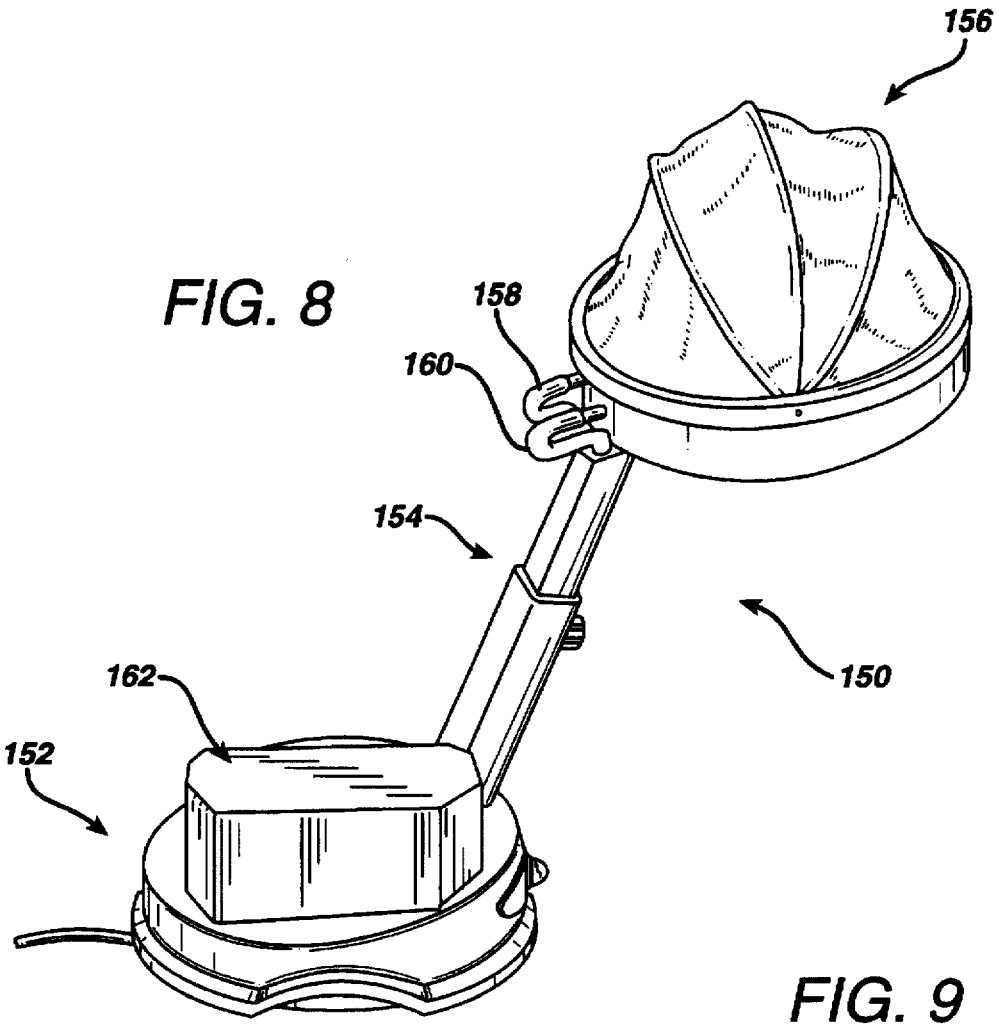
FIG. 8 is a perspective view of another embodiment of the portable hair steamer.

Referring now to FIG. 8, there is disclosed another embodiment of a portable hair steaming apparatus. Portable hair steamer 150 is similar to portable hair steamer 10 described hereinabove and generally includes base 152, a telescopic neck 154 and a steaming hood 156. There are also provided steam inlet line 158 and a condensate outline line 160, for admitting steam into, and withdrawing condensate out of, hood 156, respectively. Portable hair steamer 150 further includes a water chamber 162 which is a rectangular volumetric section and which may be detachable in order to supply fresh water to portable hair steamer 150. The portable hair steamer 150 is collapsible to facilitate transportation and thus water chamber 162 is placed off center to provide a base recess 155 which is configured to receive telescopic neck 154 in a collapsed position.

Figure 9:
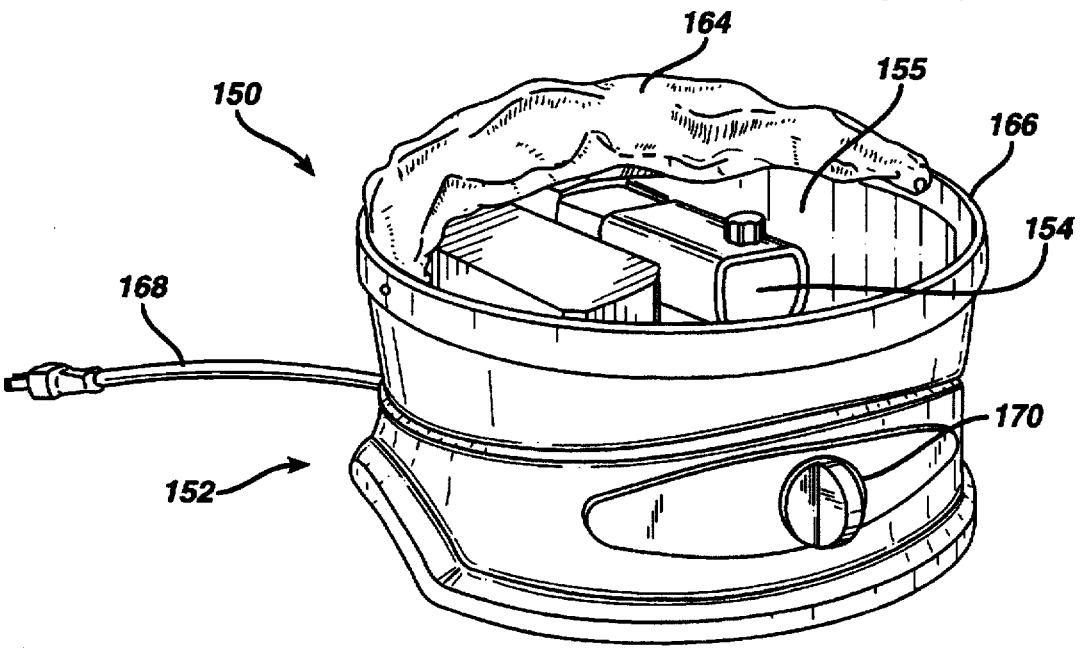
FIG. 9 is a perspective view of the portable hair steamer of FIG. 8 in a collapsed condition.

Referring now to FIG. 9, portable steamer 150 is illustrated in a collapsed condition ready for transportation and storage. As shown, neck 154 is in a collapsed condition and positioned in base 152. Additionally, cover 164 is folded back into a collapsed position within the circumference of rigid base 166. As shown, portable hair steamer 150 additionally includes power cord 168 and on/off switch 170.

Figure 10:
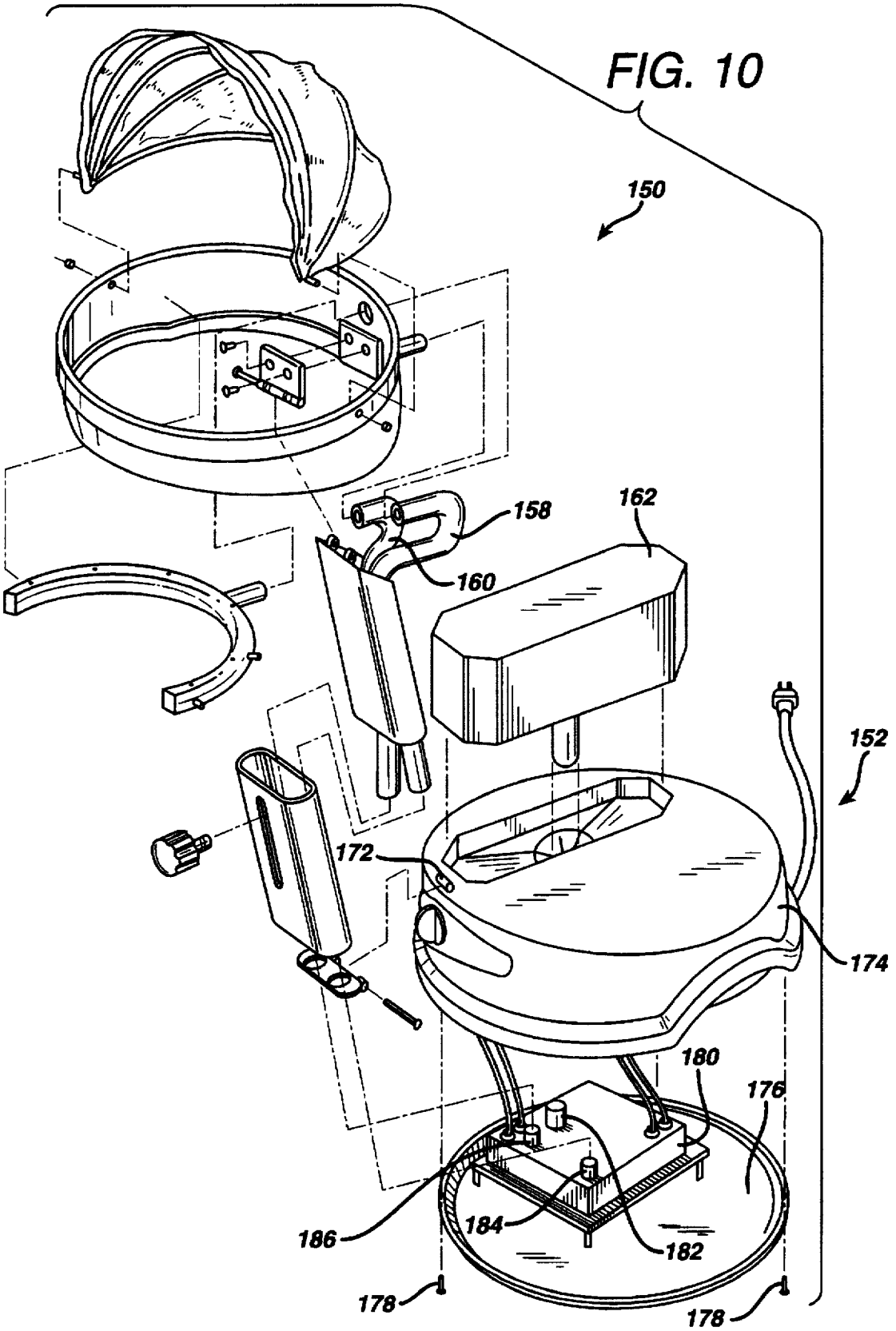
FIG. 10 is a perspective exploded view, with parts separated, of the portable hair steamer of FIG. 8.

Referring now to FIG. 10, and as noted hereinabove, portable hair steamer 150 is particularly suited to convert a limited amount of water from water chamber 162 into steam, and transporting the steam into an area within hood 156 and about the hair of the user. Base 152 includes upper base half 174 on which pivot point 172 is formed and lower base half 176. Preferably, upper base half 174 and lower base half 176 are fixed together with suitable known fasteners, such as, for example, fasteners 178.

In order to convert water received from water chamber 162 into steam, there is provided steaming chamber 180 positioned on lower base half 176. Steaming chamber 180 generally includes fluid inlet port 182 and steam outlet port 184 connected to steam inlet line 158. Preferably, condensate outlet line 160 is connected to condensate inlet port 186 in steaming chamber 180 which helps minimize the amount of water used and also provides a source of preheated water to steaming chamber 180.

Figure 11:
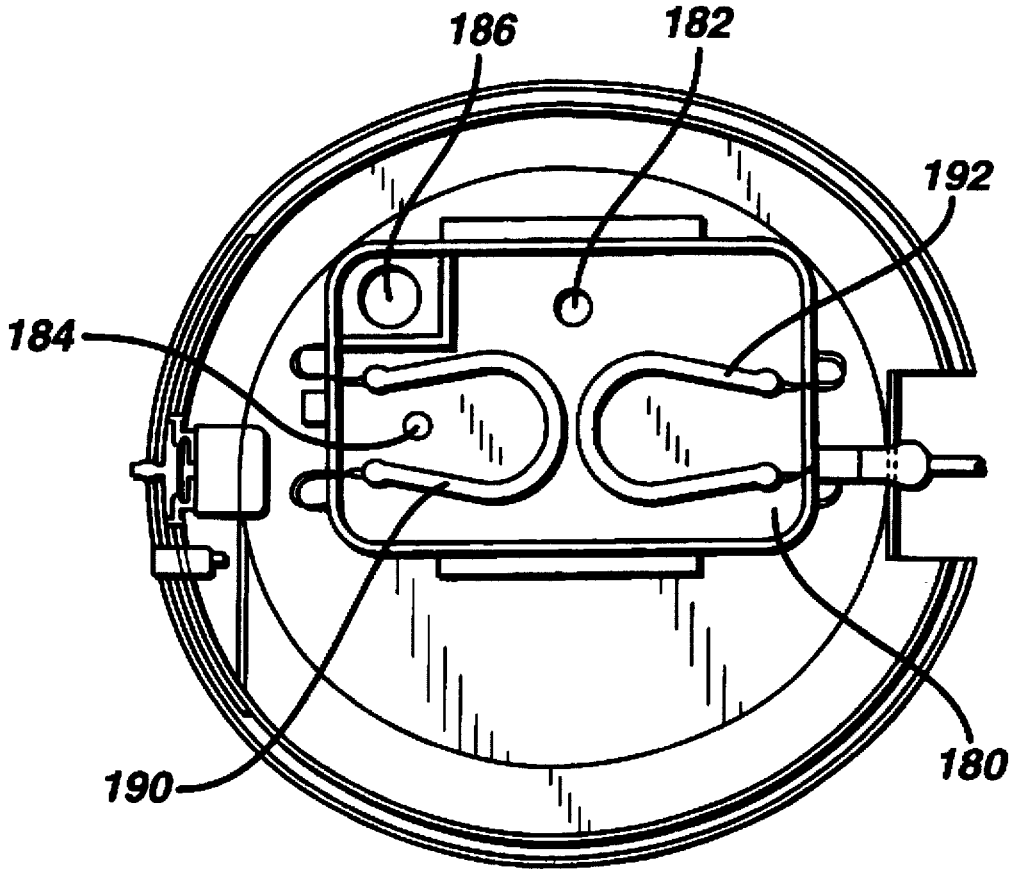
FIG. 11 is a top view, shown in cross section, of a lower base half used within the portable hair steamer of FIG. 8.

Referring to FIG. 11, lower base half 176 is illustrated in a top sectional view. Water flows in through fluid inlet port 182 from water chamber 162 into steaming chamber 180. Heating elements 190 and 192 are arranged, for example, side by side to boil water in steaming chamber 180 which is converted to steam to flow out through stream outlet 184. The condensate fluid backs into steaming chamber 180 through condensate inlet port 186.

Figure 12:
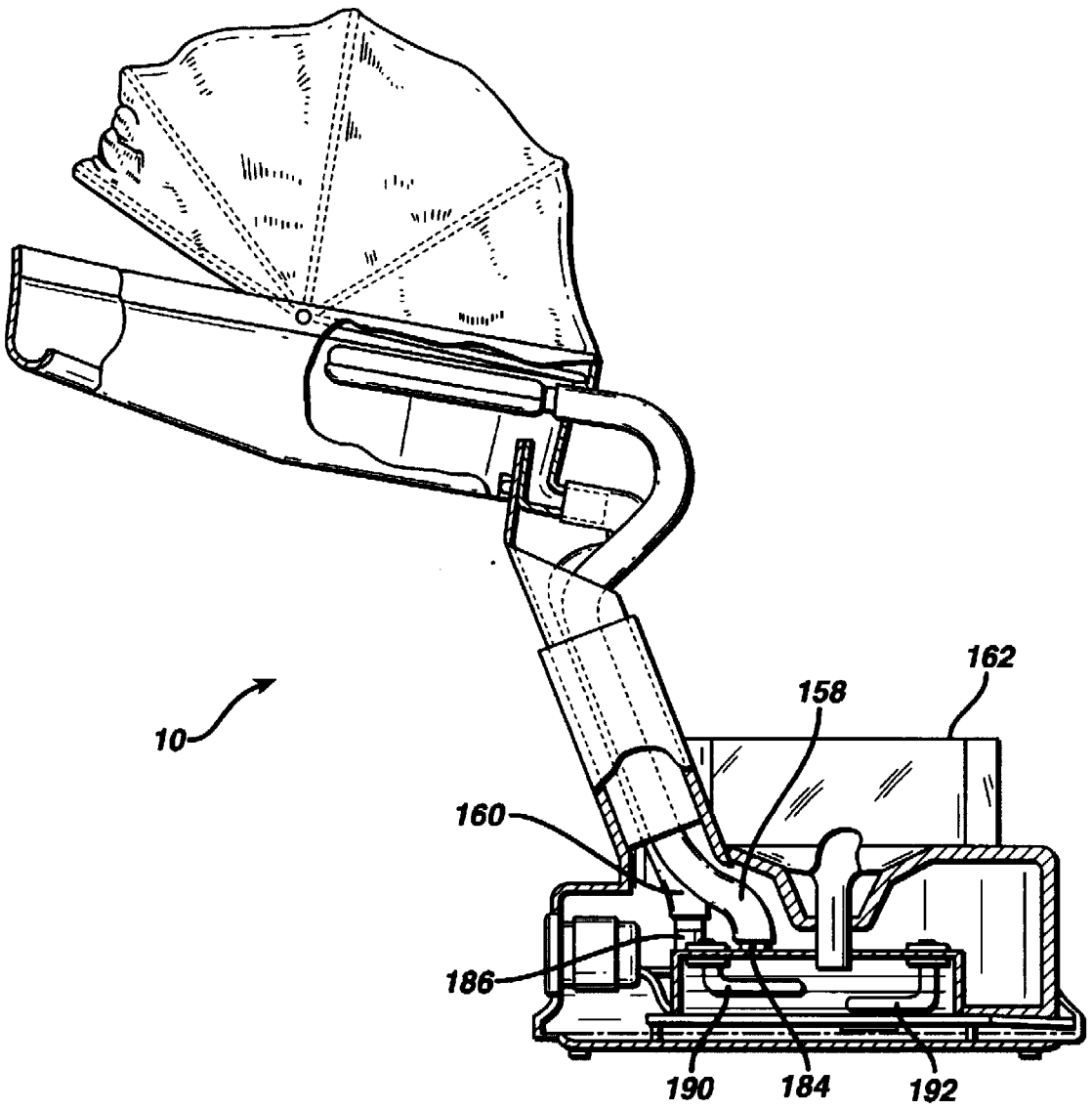
FIG. 12 is a side elevational view, partly shown in cross section, of the portable hair steamer of FIG. 8.

Referring to FIG. 12, as heating elements 190 and 192 boil water within steaming chamber 180, the water is converted to steam and flows out through steam inlet line 158. During the hair steaming operation any steam which condenses within an inner surface of hood 156 is collected and channeled through condensate outlet line 160. Preferably, condensate outlet line 160 channels the condensate fluid back into steaming chamber 180 through condensate inlet port 186.

It will be understood that various modifications may be made to the embodiments disclosed herein. For example, various other water tank arrangements may be provide to supply fresh water and collect any condensate formed within the hood 16. Therefore, the above description should not be construed as limiting, but merely as exemplifications of preferred embodiments. Those skilled in the art will envision other modifications within the scope and spirit of the claims appended hereto.

What is claimed is:

1. A hair steamer comprising:

a) a base having an exterior portion;

b) a steaming chamber supported upon said base, said steaming chamber for receiving and converting water into steam;

c) a water tank in fluid communication with said steaming chamber and configured to supply a predetermined rate of water to said steaming chamber;

d) a hood associated with said base having an interior portion, and configured to surround at least a portion of a head of a user of said hair steamer within said interior portion of said hood;

(e) means for conveying steam generated within said steaming chamber to said interior portion of said hood; and (f) steam communicating means associated with said base for communicating steam to said exterior portion of said base including at least one support member for accommodating and heating hair curlers.

2. The hair steamer according to claim 1, wherein said conveying means includes a manifold disposed within said hood and a steam line extending between said manifold and said steaming chamber.

3. The hair steamer according to claim 1, wherein said steaming chamber includes a heating element for converting water received from said water tank into steam, said heating element being disposed within said steaming chamber such that water released by said water tank is substantially instantaneously converted into steam.

4. The hair steamer according to claim 1, wherein said water tank includes a valve for supplying water at a predetermined rate to said steaming chamber.

5. The hair steamer according to claim 1, wherein said hood includes a relatively rigid base potion and a cover attached to said rigid base portion.

6. The hair steamer according to claim 5, wherein said rigid base portion includes a trough disposed around an interior thereof for collecting condensate formed within said hood.

7. The hair steamer according to claim 5, wherein cover is movably attached to said rigid base portion.

8. The hair steamer according to claim 7, wherein said cover is flexible and includes a plurality of support members movably attached to said rigid base portion.

9. The hair steamer according to claim 1 further comprising an adjustable neck portion mounted at one end to said base and supporting said hood at an opposite end thereof.

10. The hair steamer according to claim 1, further comprising a temperature regulation means disposed within said steaming chamber for turning on and off a heating assembly disposed within said steaming chamber in response to temperature, as related to a predetermined water level in said steaming chamber.

11. The hair steamer according to claim 1, further comprising a timer associated with said base for limiting the duration of time water is converted into steam within said steaming chamber.

12. The hair steamer according to claim 1, wherein said water tank is detachably mounted on said base.

13. The hair steamer according to claim 1, further comprising a water level indicator disposed within said steaming chamber for turning on and off a heating assembly disposed in said steaming chamber in response to a predetermined water level.

14. A hair curler heater comprising:

a) a base;

b) a steaming chamber disposed within said base;

c) a water tank associated with said base and communicable with said steaming chamber for supplying water at a predetermined rate to the steaming chamber;

d) a steaming post associated with said base, said steaming post dimensioned and configured to receive a hair curler thereon; and e) means for conveying steam from said steaming chamber to said steaming post.

* * * * *